US008800172B2

(12) United States Patent
Dua et al.

(10) Patent No.: US 8,800,172 B2
(45) Date of Patent: Aug. 12, 2014

(54) ARTICLE OF FOOTWEAR HAVING A KNIT UPPER WITH A POLYMER LAYER

(75) Inventors: Bhupesh Dua, Portland, OR (US); Benjamin A. Shaffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 512 days.

(21) Appl. No.: 13/079,653

(22) Filed: Apr. 4, 2011

(65) Prior Publication Data

US 2012/0246973 A1 Oct. 4, 2012

(51) Int. Cl.

| | |
|---|---|
| ***A43C 11/00*** | (2006.01) |
| ***A43B 23/00*** | (2006.01) |
| ***A43B 23/07*** | (2006.01) |

(52) U.S. Cl.

USPC ..... 36/50.1; 36/45; 36/55; 36/3 B

(58) Field of Classification Search

USPC ..... 36/45, 5, 7, 50.1, 55, 57

See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |
| 1,597,934 | A | 8/1926 | Stimpson |
| 1,888,172 | A | 11/1932 | Joha |
| 1,902,780 | A | 3/1933 | Holden et al. |
| 1,910,251 | A | 5/1933 | Joha |
| 2,001,293 | A | 5/1935 | Wilson |
| 2,047,724 | A | 7/1936 | Zuckerman |
| 2,147,197 | A | 2/1939 | Glidden |
| 2,314,098 | A | 3/1943 | McDonald |
| 2,330,199 | A | 9/1943 | Basch |
| 2,343,390 | A | 3/1944 | Ushakoff |
| 2,400,692 | A | 5/1946 | Herbert |
| 2,440,393 | A | 4/1948 | Clark |
| 2,569,764 | A | 10/1951 | Jonas |
| 2,586,045 | A | 2/1952 | Hoza |
| 2,608,078 | A | 8/1952 | Anderson |
| 2,641,004 | A | 6/1953 | Whiting et al. |
| 2,675,631 | A | 4/1954 | Doughty |
| 3,583,081 | A | 6/1971 | Hayashi |

(Continued)

FOREIGN PATENT DOCUMENTS

| | | |
|---|---|---|
| DE | 1084173 | 6/1960 |
| DE | 19738433 | 4/1998 |

(Continued)

OTHER PUBLICATIONS

International Search Report and Written Opinion in PCT Application No. PCT/2012/030273, mailed on Oct. 26, 2012.

(Continued)

*Primary Examiner* — Ted Kavanaugh

(74) *Attorney, Agent, or Firm* — Plumsea Law Group, LLC

(57) ABSTRACT

An article of footwear has an upper and a sole structure secured to the upper. The upper includes a knitted component and a polymer layer. The knitted component is formed of unitary knit construction and extends along a lateral side of the upper, along a medial side of the upper, over a forefoot region of the upper, and around a heel region of the upper. The polymer layer is bonded to the knitted component and may form a majority of an exterior surface of the upper. The polymer layer may be formed from a thermoplastic polymer material.

22 Claims, 11 Drawing Sheets

(56) References Cited

U.S. PATENT DOCUMENTS

| | | | | |
|---|---|---|---|---|
| 3,694,940 | A | 10/1972 | Stohr | |
| 3,704,474 | A | 12/1972 | Winkler | |
| 3,766,566 | A | 10/1973 | Tadokoro | |
| 3,778,856 | A | 12/1973 | Christie et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von Den Benken et al. | |
| 4,211,806 | A | 7/1980 | Civardi et al. | |
| 4,255,949 | A | 3/1981 | Thorneburg | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,607,439 | A | 8/1986 | Sogabe et al. | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 5,095,720 | A | 3/1992 | Tibbals, Jr. | |
| 5,152,025 | A | 10/1992 | Hirmas | |
| 5,192,601 | A | 3/1993 | Neisler | |
| 5,345,638 | A | 9/1994 | Nishida | |
| 5,353,524 | A | 10/1994 | Brier | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,729,918 | A | 3/1998 | Smets | |
| 5,735,145 | A | 4/1998 | Pernick | |
| 5,746,013 | A | 5/1998 | Fay, Sr. | |
| 6,308,438 | B1 | 10/2001 | Throneburg et al. | |
| 6,333,105 | B1 | 12/2001 | Tanaka et al. | |
| 6,558,784 | B1 | 5/2003 | Norton et al. | |
| 6,588,237 | B2 | 7/2003 | Cole et al. | |
| 6,910,288 | B2 | 6/2005 | Dua | |
| 6,931,762 | B1 | 8/2005 | Dua | |
| 7,047,668 | B2 * | 5/2006 | Burris et al. | 36/3 A |
| 7,051,460 | B2 | 5/2006 | Orei et al. | |
| 7,056,402 | B2 | 6/2006 | Koerwien et al. | |
| 7,347,011 | B2 | 3/2008 | Dua et al. | |
| 7,682,219 | B2 | 3/2010 | Falla | |
| 2002/0078599 | A1 | 6/2002 | Delgorgue et al. | |
| 2002/0148258 | A1 | 10/2002 | Cole et al. | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2005/0115284 | A1 | 6/2005 | Dua | |
| 2005/0193592 | A1 | 9/2005 | Dua et al. | |
| 2005/0284000 | A1 | 12/2005 | Kerns | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0110048 | A1 | 5/2008 | Dua et al. | |
| 2008/0110049 | A1 * | 5/2008 | Sokolowski et al. | 36/50.1 |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0043253 | A1 | 2/2010 | Dojan | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0251564 | A1 | 10/2010 | Meschter | |
| 2011/0078921 | A1 | 4/2011 | Greene et al. | |
| 2012/0255201 | A1 | 10/2012 | Little | |

FOREIGN PATENT DOCUMENTS

| | | |
|---|---|---|
| DE | 19728848 | 1/1999 |
| EP | 0448714 | 10/1991 |
| EP | 0728860 | 8/1996 |
| EP | 0758693 | 2/1997 |
| EP | 1233091 | 8/2002 |
| FR | 2171172 | 9/1973 |
| GB | 538865 | 8/1941 |
| GB | 1603487 | 11/1981 |
| JP | H06113905 | 4/1994 |
| JP | H08109553 | 4/1996 |
| JP | H11302943 | 11/1999 |
| NL | 7304678 | 10/1974 |
| WO | 9003744 | 4/1990 |
| WO | 0032861 | 6/2000 |
| WO | 0231247 | 4/2002 |

OTHER PUBLICATIONS

Declaration of Dr. Edward C. Frederick from the US Patent and Trademark Office Inter Partes Review of US Patent No. 7,347,011 (178 pp).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Preliminary Report on Patentability mailed Oct. 17, 2013 in International Application No. PCT/US2012/030273.

* cited by examiner

ARTICLE OF FOOTWEAR HAVING A KNIT UPPER WITH A POLYMER LAYER

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally utilized in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each impart different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each impart different properties to various areas of the footwear.

SUMMARY

An article of footwear is disclosed below as having an upper and a sole structure secured to the upper. The upper includes a knitted component and a polymer layer. The knitted component is formed of unitary knit construction and extends along a lateral side of the upper, along a medial side of the upper, over a forefoot region of the upper, and around a heel region of the upper. The polymer layer is bonded to the knitted component and may form a majority of an exterior surface of the upper. The polymer layer may be formed from a thermoplastic polymer material.

A method of manufacturing an article of footwear is also disclosed. The method includes utilizing a flat knitting process to form a knitted component having a first surface and an opposite second surface. A polymer layer is bonded to the first surface of the knitted component. Additionally, the knitted component and the polymer layer are incorporated into an upper of the article of footwear.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
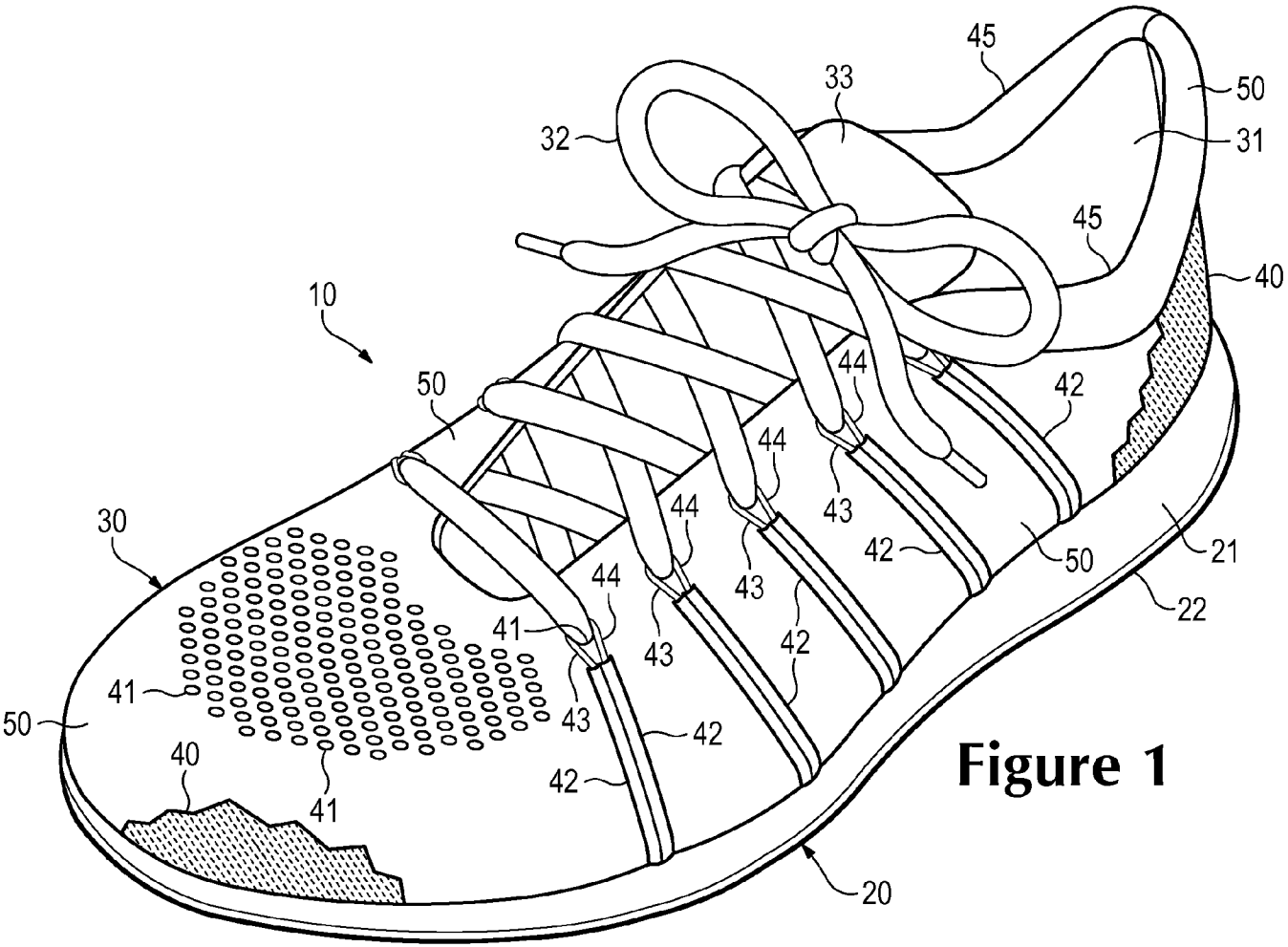
FIG. 1 is a perspective view of an article of footwear.

The following discussion and accompanying figures disclose an article of footwear having an upper that includes a knitted component and a polymer layer. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, tennis shoes, soccer shoes, sprinting shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

An article of footwear 10 is depicted in FIGS. 1-5D as including a sole structure 20 and an upper 30. For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and an sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate a fluid-filled bladder that supplements the ground reaction force attenuation properties, or midsole 21 may be primarily formed from the fluid-filled bladder. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30 defines a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through portions of upper 30, as described in greater detail below, and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). In addition, upper 30 includes a tongue 33 that extends under lace 32.

A majority of upper 30 is formed from a knitted component 40 and a polymer layer 50. Knitted component 40 may, for example, be manufactured through a flat knitting process and extends through each of regions 11-13, along both lateral side 14 and medial side 15, over forefoot region 11, and around heel region 13. In addition, knitted component 40 forms an interior surface of upper 30. As such, knitted component 40 defines at least a portion of the void within upper 30. In some configurations, knitted component 40 may also extend under the foot. For purposes of example in the various figures, however, a strobel sock 34 is secured to knitted component 40 and forms a majority of the portion of upper 30 that extends under the foot. In this configuration, sockliner 23 extends over strobel sock 34 and forms a surface upon which the foot rests.

Polymer layer 50 forms an exterior surface of upper 30 and is secured to an exterior area of knitted component 40. In general, polymer layer 50 lays adjacent to knitted component 40 and is secured to knitted component 40 to form the exterior surface of upper 30. As with knitted component 40, polymer layer 50 extends through each of regions 11-13, along both lateral side 14 and medial side 15, over forefoot region 11, and around heel region 13. Although polymer layer 50 may extend into footwear 10 and over other areas of knitted component 40, polymer layer 50 is depicted as being primarily located to form the exterior surface of upper 30. Although polymer layer 50 is depicted as forming a majority of the exterior surface of upper 30, polymer layer 50 may be absent in various areas to expose portions of knitted component 40.

The combination of knitted component 40 and polymer layer 50 provides various advantages to footwear 10. As an example, the combination of knitted component 40 and polymer layer 50 imparts a relatively tight and glove-like fit to upper 30. When formed as a soccer shoe, for example, the relatively tight and glove-like fit may provide the wearer with enhanced feel and control of a ball. Polymer layer 50 may also be utilized to reinforce areas of upper 30. For example, polymer layer 50 may inhibit stretch in knitted component 40 and may enhance the wear-resistance or abrasion-resistance of upper 30. Polymer layer 50 may also impart water-resistance to footwear 10. Additionally, forming footwear 10 in this configuration may provide uniform fit and conformance to the foot, a seamless interior with enhanced comfort for the wearer, a relatively light weight, and support for the foot without overlays.

Knitted Component Configuration

Figure 4:
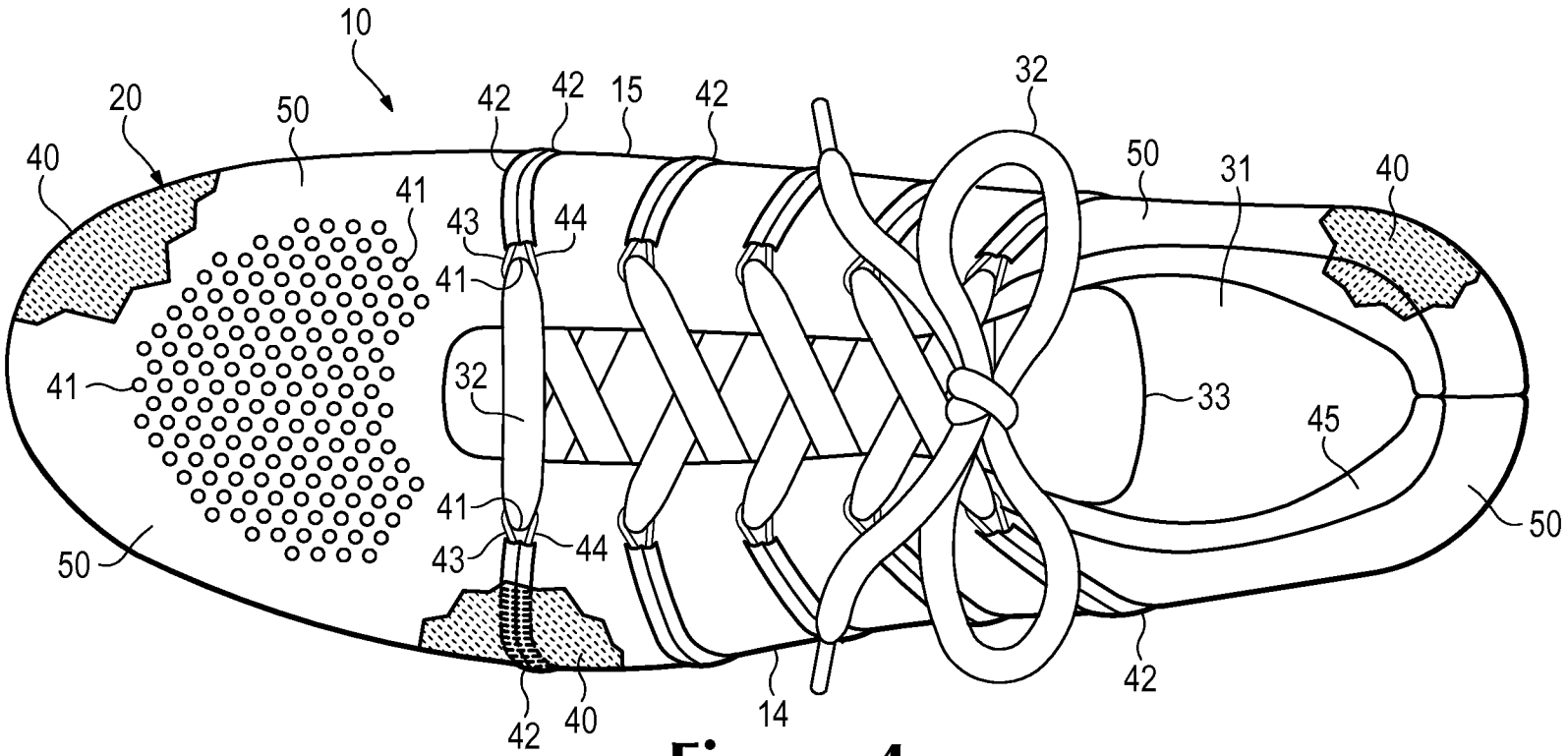
FIG. 4 is a top plan view of the article of footwear.
Figure 5A:
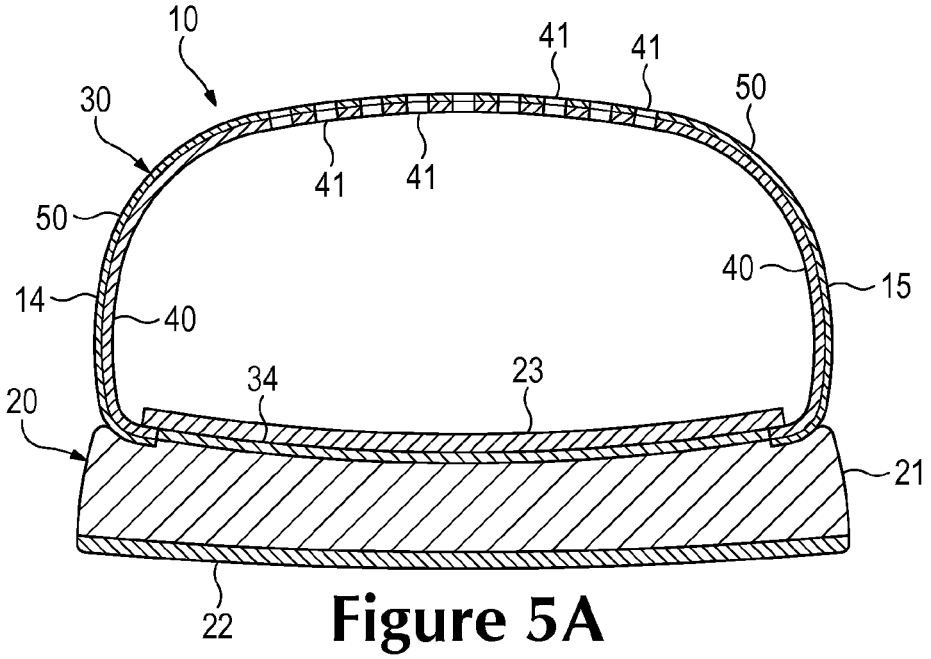
FIGS. 5A-5D are cross-sectional views of the article of footwear, as respectively defined by section lines 5A-5D in FIG. 2.

Knitted component 40 incorporates various knit types that impart different properties to separate areas of upper 30. As an example that is depicted in FIGS. 1, 4, and 5A, knitted component 40 forms various apertures 41 that extend through upper 30 in forefoot region 11, whereas many other areas of upper 30 have a more continuous or less-apertured configuration. In addition to imparting greater permeability, which allows air to circulate within upper 30, apertures 41 may increase both the flexibility and stretch of upper 30 in forefoot region 11. In order to facilitate many of these advantages, polymer layer 50 may also have various apertures that correspond in location with apertures 41. As further examples, other properties that may be varied through selecting particular knit types for a particular area of knitted component 40 include permeability to liquids, the directions in which knitted component 40 stretches or resists stretch, the stiffness of knitted component 40, and the compressibility of knitted component 40. Additional examples of knitted components for footwear uppers that have areas with different knit types to impart different properties may be found in U.S. Pat. No. 6,931,762 to Dua and U.S. Pat. No. 7,347,011 to Dua, et al., both of which are entirely incorporated herein by reference. As a related matter, the density of the knit within knitted component 40 may vary among separate areas of upper 30 to, for example, make less-permeable or stiffer portions. Accordingly, knitted component 40 may exhibit various properties in separate areas depending upon the particular knit type that is selected for the areas.

Knitted component 40 may also incorporate various yarn types that impart different properties to separate areas of upper 30. Moreover, by combining various yarn types with various stitch types, knitted component 40 may impart a range of different properties to separate areas of upper 30. The properties that a particular type of yarn will impart to an area of knitted component 40 partially depend upon the materials that form the various filaments and fibers within the yarn. Cotton, for example, provides a soft hand, natural aesthetics, and biodegradability. Elastane and stretch polyester each provide substantial stretch and recoverability, with stretch polyester also providing recyclability. Rayon provides high luster and moisture absorption. Wool also provides high moisture absorption, in addition to insulating properties. Nylon is a durable and abrasion-resistant material with high strength. Polyester is a hydrophobic material that also provides relatively high durability. In addition to materials, other aspects relating to the yarn may affect the properties of upper 30. For example, the yarn may be a monofilament yarn or a multifilament yarn. The yarn may also include separate filaments that are each formed of different materials. The yarn may also include filaments that are each formed of two or more different materials, such as a bicomponent yarn with filaments having a sheath-core configuration or two halves formed of different materials. Different degrees of twist and crimping, as well as different deniers, may affect the properties of upper 30 where the yarn is located. Accordingly, both the materials forming the yarn and other aspects of the yarn may be selected to impart a variety of properties to separate areas of upper 30.

Figure 2:
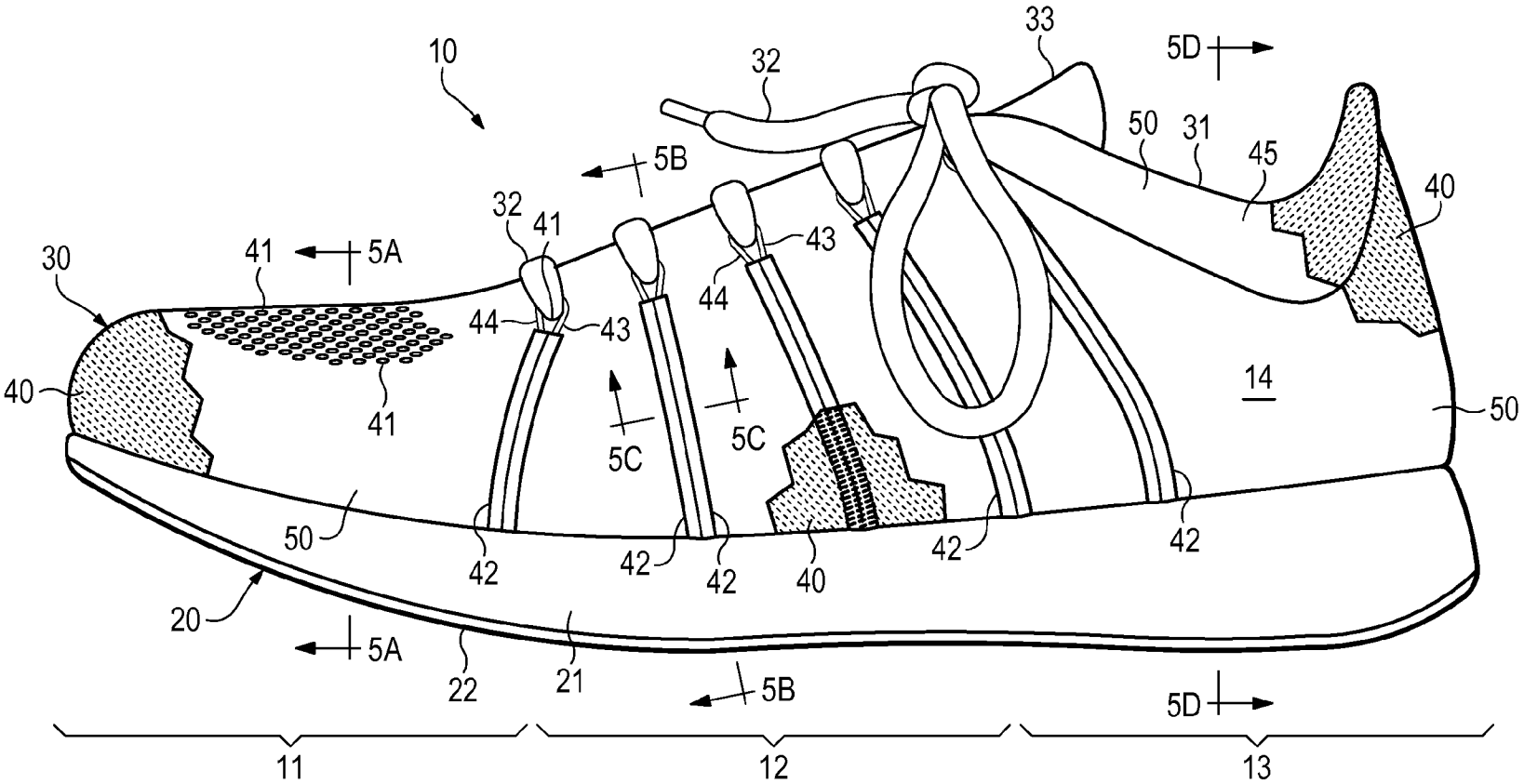
FIG. 2 is a lateral side elevational view of an article of footwear.
Figure 3:
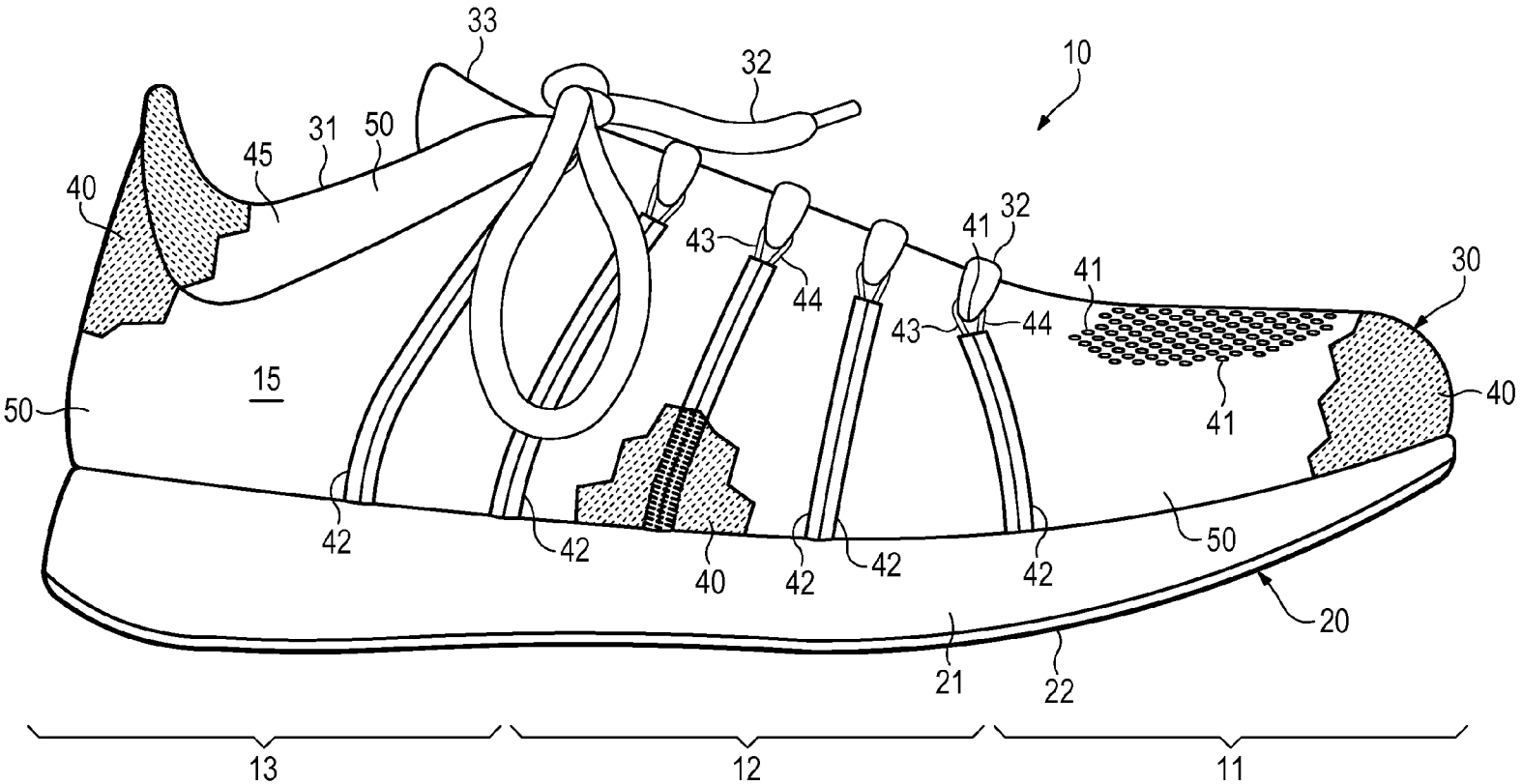
FIG. 3 is a medial side elevational view of the article of footwear.
Figure 5B:
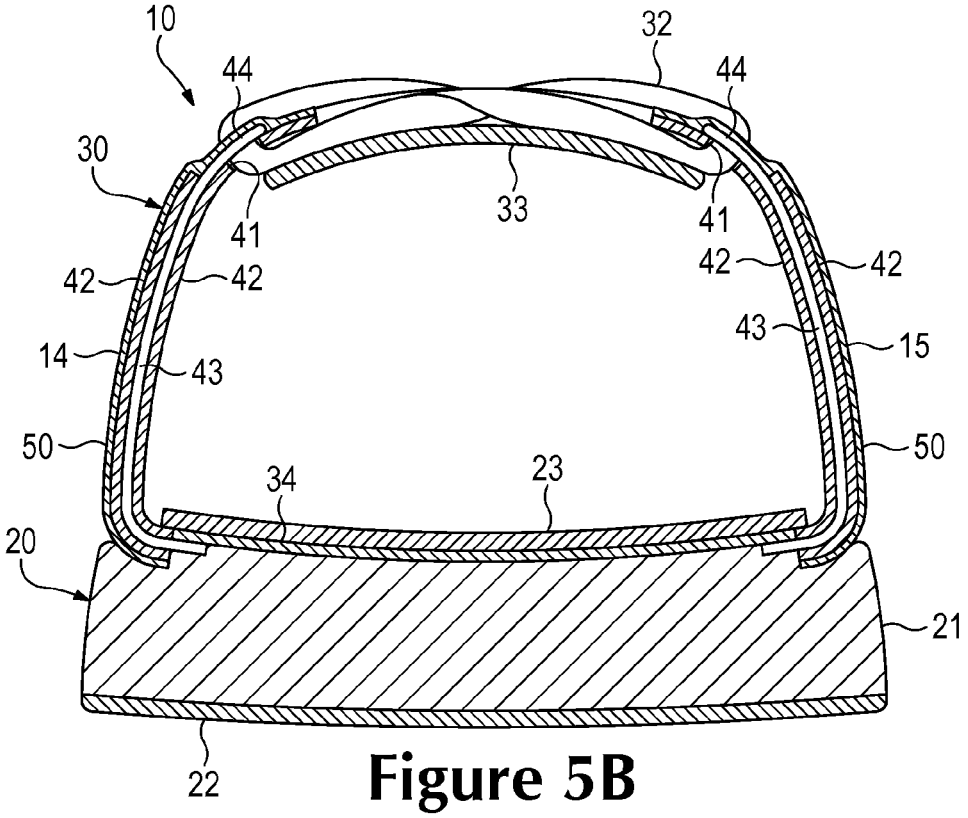
Figure 5C:
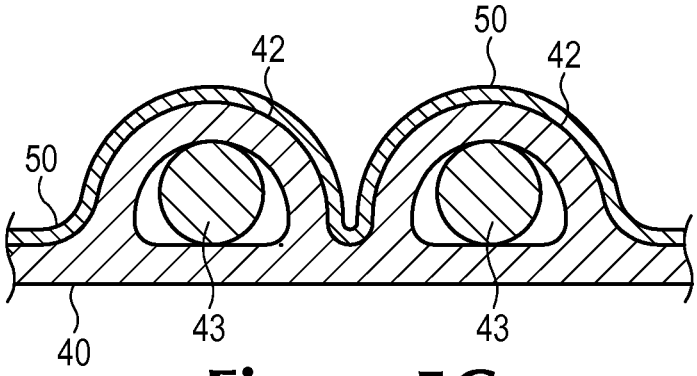

In addition to knit types and yarn types, knitted component 40 may incorporate various knitted structures. Referring to FIGS. 2 and 3, for example, knitted component 40 includes various tubes 42 in which strands 43 are located. Tubes 42 are generally hollow structures formed by two overlapping and at least partially coextensive layers of knitted material, as depicted in FIGS. 5B and 5C. Although the sides or edges of one layer of the knitted material forming tubes 42 may be secured to the other layer, a central area is generally unsecured such that another element (e.g., strands 43) may be located between the two layers of knitted material and pass through tubes 42. An additional example of knitted components for footwear uppers that have overlapping or at least partially coextensive layers may be found in U.S. Patent Application Publication 2008/0110048 to Dua, et al., which is incorporated herein by reference.

Tubes 42 extend upward along lateral side 14 and medial side 15. Each tube 42 is adjacent to at least one other tube 42 to form a tube pair. In general, one of strands 43 passes through a first tube 42 of a tube pair, extends outward from an upper end of the first tube 42, forms a loop 44, extends into an upper end of a second tube 42 of the tube pair, and passes through the second tube 42. That is, each strand 43 passes through at least two tubes 42, and an exposed portion of the strand 43 forms a loop 44. Note that loops 44 are located between knitted component 40 and polymer layer 50, as depicted in FIG. 5B. In this configuration, polymer layer 50 effectively secures the positions of loops 44 around apertures 41 through which lace 32 passes. That is, loops 44 extend around lace apertures 41 in knitted component 40, polymer layer 50 secures the positions of loops 44 around the lace apertures 41, and lace 32 may pass through both loops 44 and the lace apertures 41 to form a lacing system in footwear 10.

An individual strand 43 may only pass through two adjacent tubes 42 (i.e., a single tube pair) such that the strand 43 forms a single loop 44. In this configuration, end portions of the strand 43 exit lower ends of the two adjacent tubes 42 and may be secured to sole structure 20 under strobel sock 34, for example, to prevent the end portions from being pulled through one of tubes 42. The presence of polymer layer 50 may also be utilized to secure the positions of the end portions. In another configuration, an individual strand 43 may pass through each of tubes 42, thereby passing through multiple tube pairs and forming multiple loops 44. In yet another configuration, one strand 43 may pass through each of tubes 42 located on lateral side 14, and another strand 43 may pass through each of tubes 42 located on medial side 15. In general, therefore, an individual strand 43 passes through at least one tube pair to form at least one loop 44, but may pass through multiple tube pairs to form multiple loops 44.

Referring to FIGS. 1-4, lace 32 extends through each of loops 44 and also passes through various apertures 41 that are formed in knitted component 40 adjacent to each of loops 44. As discussed above, loops 44 are located between knitted component 40 and polymer layer 50, and polymer layer 50 effectively secures the positions of loops 44 around apertures 41 through which lace 32 passes. The combination of lace 32, the apertures 41 through which lace 32 extends, the various tubes 42 on both lateral side 14 and medial side 15, strands 43, and loops 44 provide an effective lacing system for upper 30. When lace 32 is placed in tension (i.e., when the wearer is tying lace 32), tension may also be induced in strands 43. In the absence of strands 43, other portions of knitted component 40 would bear the tension and resulting stresses from tying lace 32. The presence of strands 43, however, provides a separate element to bear the tension and stresses. Moreover, a majority of knitted component 40 may be generally formed through selection of knit type and yarn type to stretch when placed in tension, thereby allowing upper 30 to conform with the contours of the foot. Strands 43, however, may be generally non-stretch in comparison with upper 30.

Strands 43 may be formed from a variety of materials and may have the configurations of a rope, thread, webbing, cable, yarn, filament, or chain, for example. In some configurations, strands 43 are located within tubes 42 during the knitting process that forms knitted component 40. As such, strands 43 may be formed from any generally one-dimensional material that may be utilized in a knitting machine or other device that forms knitted component 40. As utilized with respect to the present invention, the term "one-dimensional material" or variants thereof is intended to encompass generally elongate materials exhibiting a length that is substantially greater than a width and a thickness. Accordingly, suitable materials for strands 43 include various filaments, fibers, and yarns, that are formed from rayon, nylon, polyester, polyacrylic, silk, cotton, carbon, glass, aramids (e.g., para-aramid fibers and meta-aramid fibers), ultra high molecular weight polyethylene, and liquid crystal polymer. In addition to filaments and yarns, other one-dimensional materials may be utilized for strands 43. Although one-dimensional materials will often have a cross-section where width and thickness are substantially equal (e.g., a round or square cross-section), some one-dimensional materials may have a width that is somewhat greater than a thickness (e.g., a rectangular, oval, or otherwise elongate cross-section). Despite the greater width, a material may be considered one-dimensional if a length of the material is substantially greater than a width and a thickness of the material.

Figure 5D:
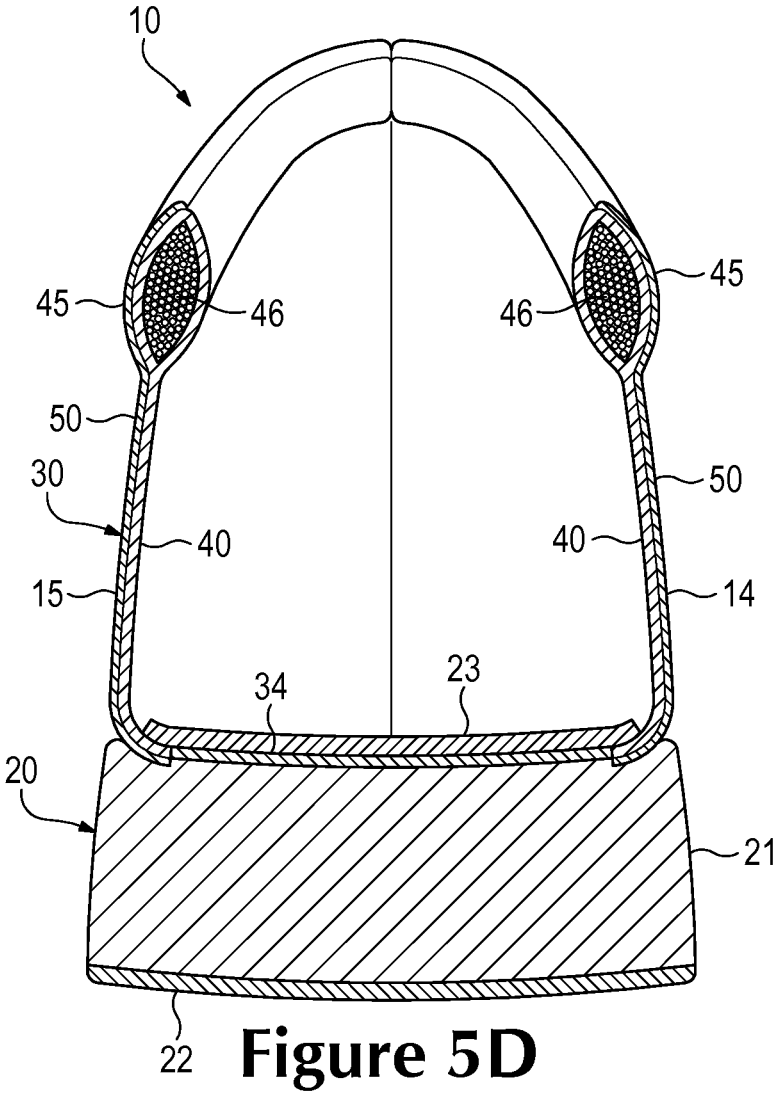

Another structure formed by knitted component 40 is a padded collar 45 that extends at least partially around ankle opening 31. Referring to FIGS. 1-3, collar 45 exhibits a greater thickness than many other portions of knitted component 40. In general, collar 45 is formed by two overlapping and at least partially coextensive layers of knitted material (i.e., a tubular structure) and a plurality of floating yarns 46 extending between the layers, as depicted in FIG. 5D. Although the sides or edges of one layer of knitted material forming collar 45 may be secured to the other layer of knitted material, a central area is generally unsecured. As such, the layers of knitted material effectively form a tube or tubular structure similar to tubes 42, and floating yarns 46 may be located or laid-in between the two layers of knitted material to pass through the tubes. That is, floating yarns 46 extend between the layers of knitted material, are generally parallel to surfaces of the knitted material, and also pass through and fill an interior volume between the layers. Whereas a majority of knitted component 40 is formed from yarns that are mechanically-manipulated to form a knitted structure, floating yarns 46 are generally free or otherwise laid-in within the interior volume between the layers of knitted material forming the exterior of collar 45.

Whereas tubes 42 include a single strand 43, collar 45 includes a plurality of floating yarns 46 that extend through the area between the layers of knitted material. Accordingly, knitted component 40 may form generally tubular structures having one or multiple yarns within the tubular structures. Moreover, floating yarns 46 may be formed from a variety of materials and may be located within collar 45 during the knitting process that forms knitted component 40. As such, floating yarns 46 may be formed from any generally one-dimensional material that may be utilized in a knitting machine or other device that forms knitted component 40.

The presence of floating yarns 46 imparts a compressible aspect to collar 45, thereby enhancing the comfort of footwear 10 in the area of ankle opening 31. Many conventional articles of footwear incorporate polymer foam elements or other compressible materials into a collar area. In contrast with the conventional articles of footwear, collar 45 utilizes floating yarns 46 to provide a compressible structure.

The combination of tubes 42 and strands 43 provides upper 30 with a structural element that, for example, resists stretch in a lacing system. Similarly, the combination of collar 45 and floating yarns 46 provides upper 30 with a structural element that, for example, compresses to impart greater comfort around ankle opening 31. Although these knitted structures provide different benefits to upper 30, these knitted structures are similar in that each includes (a) a tubular structure formed from two overlapping and at least partially coextensive layers of knitted material formed of unitary knit construction and (b) at least one yarn, strand, or other one-dimensional material that is laid-in or otherwise located within the tubular structure and extends through at least a portion of a length of the tubular structure.

Flat Knitting Process

A flat knitting process may be utilized to manufacture knitted component 40. Flat knitting is a method for producing a knitted material that is turned periodically (i.e., the material is knitted from alternating sides). The two sides (otherwise referred to as faces) of the material are conventionally designated as the right side (i.e., the side that faces outwards, towards the viewer) and the wrong side (i.e., the side that faces inwards, away from the viewer). Although flat knitting provides a suitable manner for forming knitted component 40, other knitting processes may also be utilized, depending upon the features that are incorporated into knitted component 40. Examples of other knitting processes that may be utilized include wide tube circular knitting, narrow tube circular knit jacquard, single knit circular knit jacquard, double knit circular knit jacquard, warp knit tricot, warp knit raschel, and double needle bar raschel.

An advantage to utilizing a flat knitting process to manufacture knitted component 40 is that each of the features discussed above may be imparted to knitted component 40 through the flat knitting process. That is, a flat knitting process may form knitted component 40 to have, for example, (a) various knit types that impart different properties to separate areas of upper 30, (b) various yarn types that impart different properties to separate areas of upper 30, (c) knitted components with the configuration of overlapping knitted layers in tubes 42, (d) a material such as strand 43 that is laid into tubes 42, (e) knitted components with the configuration of overlapping knitted layers in collar 45, and (f) floating yarns between layers of knitted material in collar 45. Moreover, each of these features, as well as other features, may be incorporated into knitted component 40 through a single flat knitting process. As such, a flat knitting process may be utilized to substantially form upper 30 to have various properties and structural features that are advantageous to footwear 10.

Although one or more yarns may be mechanically-manipulated by an individual to form knitted component 40 (i.e., knitted component 40 may be formed by hand), flat-knitting machines may provide an efficient manner of forming relatively large numbers of knitted component 40. The flat-knitting machines may also be utilized to vary the dimensions of knitted component 40 to form uppers 30 that are suitable for footwear with different sizes based on one or both of the length and width of a foot. Additionally, the flat-knitting machines may be utilized to vary the configuration of knitted component 40 to form uppers 30 that are suitable for both left and right feet. Various aspects of knitted component 40 may also be varied to provide a custom fit for individuals. Accordingly, the use of mechanical flat-knitting machines may provide an efficient manner of forming multiple knitted components 40 having different sizes and configurations.

Knitted component 40 incorporates various features and structures formed of unitary knit construction. In general, the features and structures are formed of unitary knit construction when incorporated into knitted component 40 through the flat knitting process, rather than other processes (e.g., stitching, bonding, shaping) that are performed after the flat knitting process. As an example, tubes 42 and portions of collar 45 are formed from overlapping and at least partially coextensive layers of knitted material, and sides or edges of one layer may be secured to the other layer. The two layers of knitted material are generally formed during the flat knitting process and do not involve supplemental stitching, bonding, or shaping processes. The overlapping layers are, therefore, formed of unitary knit construction through the flat knitting process. As another example, the regions of knitted component 40 formed from knit types that define apertures 41 are formed of unitary knit construction through the flat knitting process. As yet another example, floating yarns 46 are formed of unitary knit construction.

A further advantage of utilizing a flat knitting process to form knitted component 40 is that three-dimensional aspects may be incorporated into upper 30. Upper 30 has a curved or otherwise three-dimensional structure that extends around the foot and conforms with a shape of the foot. The flat knitting process may, for example, form areas of knitted component 40 with some curvature in order to complement the shape of the foot. Examples of knitted components for footwear uppers that have three-dimensional aspects may be found in U.S. Patent Application Publication 2008/0110048 to Dua, et al., which is incorporated herein by reference.

Figure 6:
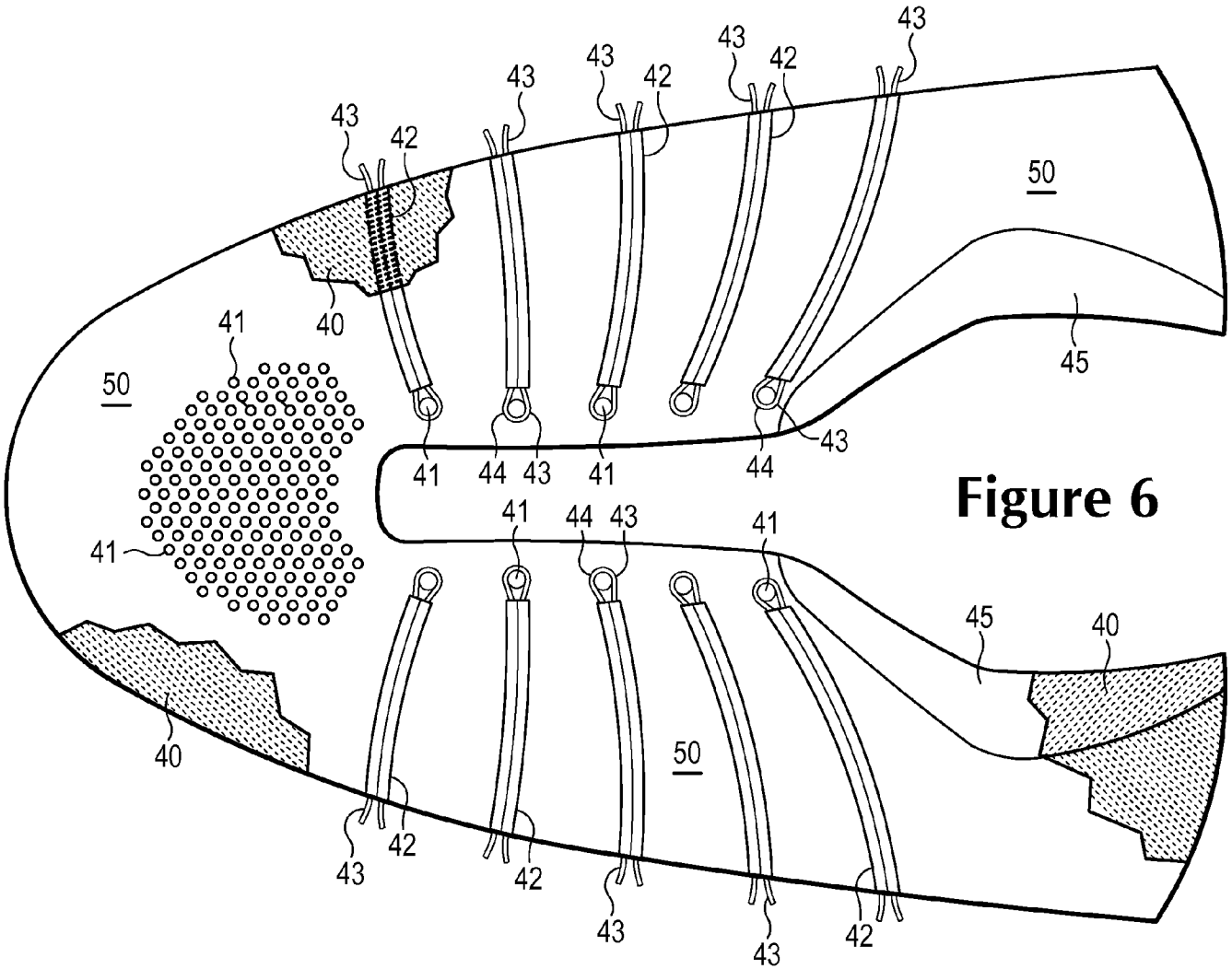
FIG. 6 is a top plan view of an upper component that forms a portion of an upper of the article of footwear.
Figure 7:
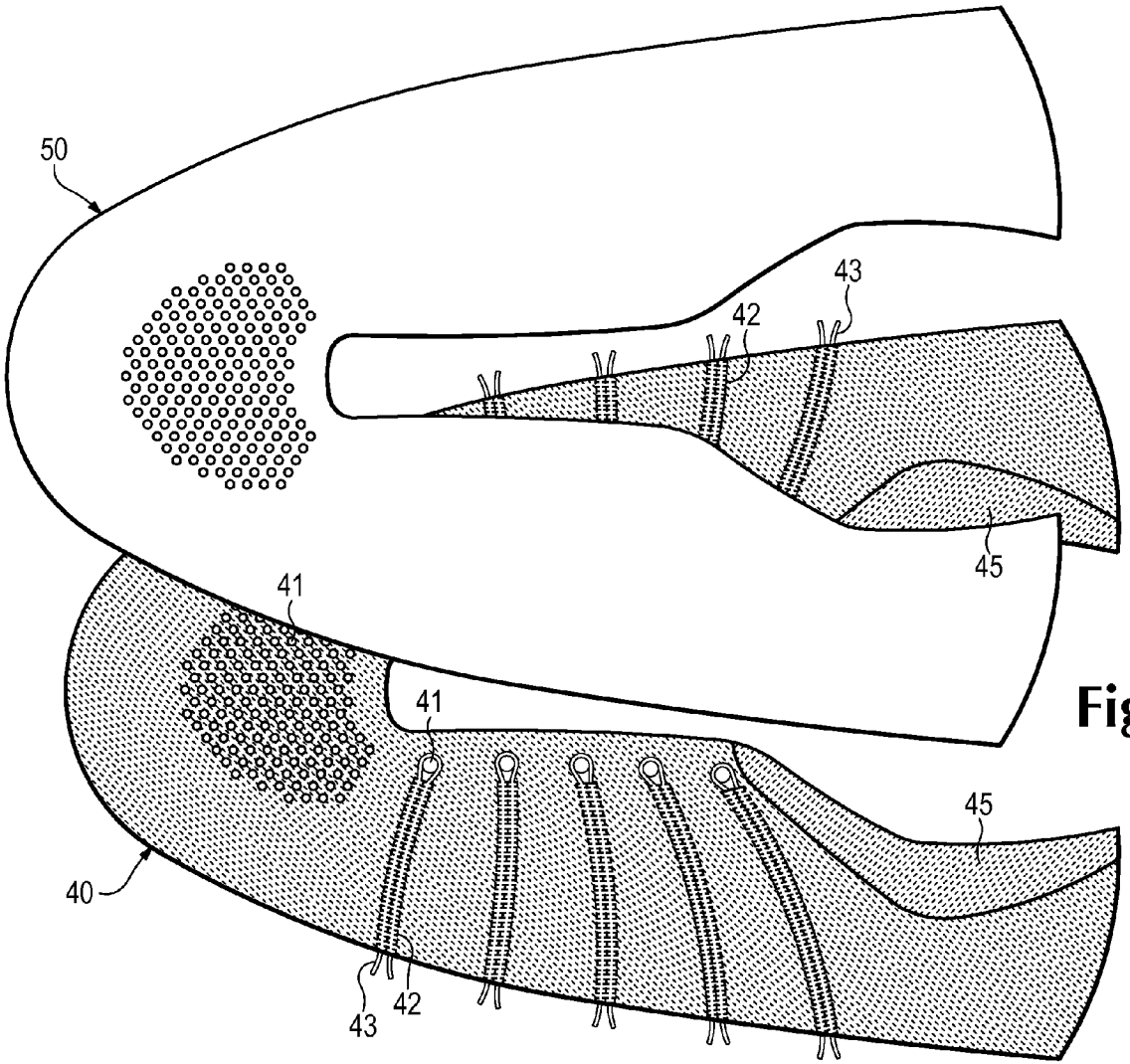
FIG. 7 is an exploded top plan of the upper component.

Knitted component 40 and polymer layer 50 are depicted separate from footwear 10 in FIGS. 6 and 7. Whereas edges of many textile materials are cut to expose ends of the yarns forming the textile materials, knitted component 40 may be formed to have a finished configuration. That is, flat-knitting or other knitting techniques may be utilized to form knitted component 40 such that ends of the yarns within knitted component 40 are substantially absent from the edges of knitted component 40. An advantage of the finished configuration formed through flat-knitting is that the yarns forming the edges of knitted component 40 are less likely to unravel, which is an inherent issue with weft knit materials. By forming finished edges, the integrity of knitted component 40 is strengthened and fewer or no post-processing steps are required to prevent unraveling. In addition, loose yarns are also less likely to inhibit the aesthetic appearance of upper 30. In other words, the finished configuration of knitted component 40 may enhance the durability and aesthetic qualities of upper 20, while increasing manufacturing efficiency.

Knitted component 40 provides one example of a configuration that is suitable for upper 30 of footwear 10. Depending upon the intended use of an article of footwear, the desired properties of the article of footwear, and advantageous structural attributes of the article of footwear, for example, a knitted component similar to knitted component 40 may be formed through flat knitting to have the desired features. That is, flat knitting may be utilized to (a) locate specific knit types in desired areas of the knitted component, (b) locate specific yarn types in desired areas of the knitted component, (c) form overlapping knitted layers similar to tubes 42 and collar 45 in desired areas of the knitted component, (d) place strands or floating yarns similar to strands 43 and floating yarns 46 between the knitted layers, (e) form three-dimensional aspects in the knitted component, and (f) impart finished edges. More particularly, any of the features discussed above, for example, may be mixed and matched within a knitted component to form specific properties or structural attributes for a footwear upper.

Polymer Layer Configuration

Polymer layer 50 lays adjacent to knitted component 40 and is secured to knitted component 40 to form the exterior surface of upper 30. A variety of structures may be utilized for polymer layer 50, including polymer films, polymer meshes, polymer powders, and non-woven textiles, for example. With any of these structures, a variety of polymer materials may be utilized for polymer layer 50, including polyurethane, polyester, polyester polyurethane, polyether polyurethane, and nylon. Although polymer layer 50 may be formed from a thermoset polymer material, many configurations of polymer layer 50 are formed from thermoplastic polymer materials (e.g., thermoplastic polyurethane). In general, a thermoplastic polymer material melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, the thermoplastic polymer material may be melted, molded, cooled, re-melted, re-molded, and cooled again through multiple cycles. Thermoplastic polymer materials may also be welded or thermal bonded, as described in greater detail below, to textile elements, such as knitted component 40. Although many thermoplastic polymer materials may be utilized for polymer layer 50, an advantage to utilizing thermoplastic polyurethane relates to thermal bonding and colorability. In comparison with various other thermoplastic polymer materials (e.g., polyolefin), thermoplastic polyurethane is relatively easy to bond with other elements, as discussed in greater detail below, and colorants may be added to thermoplastic polyurethane through various conventional processes. As noted above, polymer layer 50 may be formed from a non-woven textile. An example of a non-woven textile with thermoplastic polymer filaments that may be bonded to knitted component 40 is disclosed in U.S. Patent Application Publication 2010/0199406 to Dua, et al., which is incorporated herein by reference.

A thermoplastic polymer material forming polymer layer 50 may be utilized to secure polymer layer 50 to knitted component 40. As discussed above, a thermoplastic polymer material melts when heated and returns to a solid state when cooled sufficiently. Based upon this property of thermoplastic polymer materials, thermal bonding processes may be utilized to form a thermal bond that joins portions of polymer layer 50 to knitted component 40. As utilized herein, the term "thermal bonding" or variants thereof is defined as a securing technique between two elements that involves a softening or melting of a thermoplastic polymer material within at least one of the elements such that the materials of the elements are secured to each other when cooled. Similarly, the term "thermal bond" or variants thereof is defined as the bond, link, or structure that joins two elements through a process that involves a softening or melting of a thermoplastic polymer material within at least one of the elements such that the materials of the elements are secured to each other when cooled. As examples, thermal bonding may involve (a) the melting or softening of polymer layer 50 such that the thermoplastic polymer materials intermingle with materials of knitted component 40 and are secured together when cooled and (b) the melting or softening of polymer layer 50 such that the thermoplastic polymer material extends into or infiltrates the structure of knitted component 40 (e.g., extends around or bonds with filaments or fibers in knitted component 40) to secure the elements together when cooled. Additionally, thermal bonding does not generally involve the use of stitching or adhesives, but involves directly bonding elements to each other with heat. In some situations, however, stitching or adhesives may be utilized to supplement the thermal bond or the joining of elements through thermal bonding. A needlepunching process may also be utilized to join the elements or supplement the thermal bond.

Manufacturing Processes

A variety of methods may be utilized to manufacture upper 30. In general, knitted component 40 is manufactured through the knitting processes discussed above. Polymer layer 50 is then secured (e.g., bonded or thermal bonded) to knitted component 40. For example, knitted component 40 and polymer layer 50 may be placed between portions of a heat press that compress and heat the elements, thereby bonding them together. In some configurations, polymer layer 50 may be a sheet or film of polymer material that is compressed and heated with knitted component 40. In another configuration, polymer layer 50 may be a non-woven textile element that is compressed and heated with knitted component 40. The compression and heating may melt the non-woven textile element to form a polymer film on the exterior of knitted component 40, or portions of the non-woven textile element may remain fibrous to impart breathability or air permeability. Details relating to the non-woven textile element may be found in U.S. Patent Application Publication 2010/0199406 to Dua, et al., which is incorporated herein by reference. In yet another configuration, polymer layer 50 may be a polymer powder that is compressed and heated with knitted component 40, and the compression and heating may melt the powder to form a polymer film on the exterior of knitted component 40. As another example, a polymer resin may be sprayed or otherwise applied to knitted component 40 to form polymer layer 50. Accordingly, various methods may be utilized to form the combination of knitted component 40 and polymer layer 50.

Further Configurations

Figure 8A:
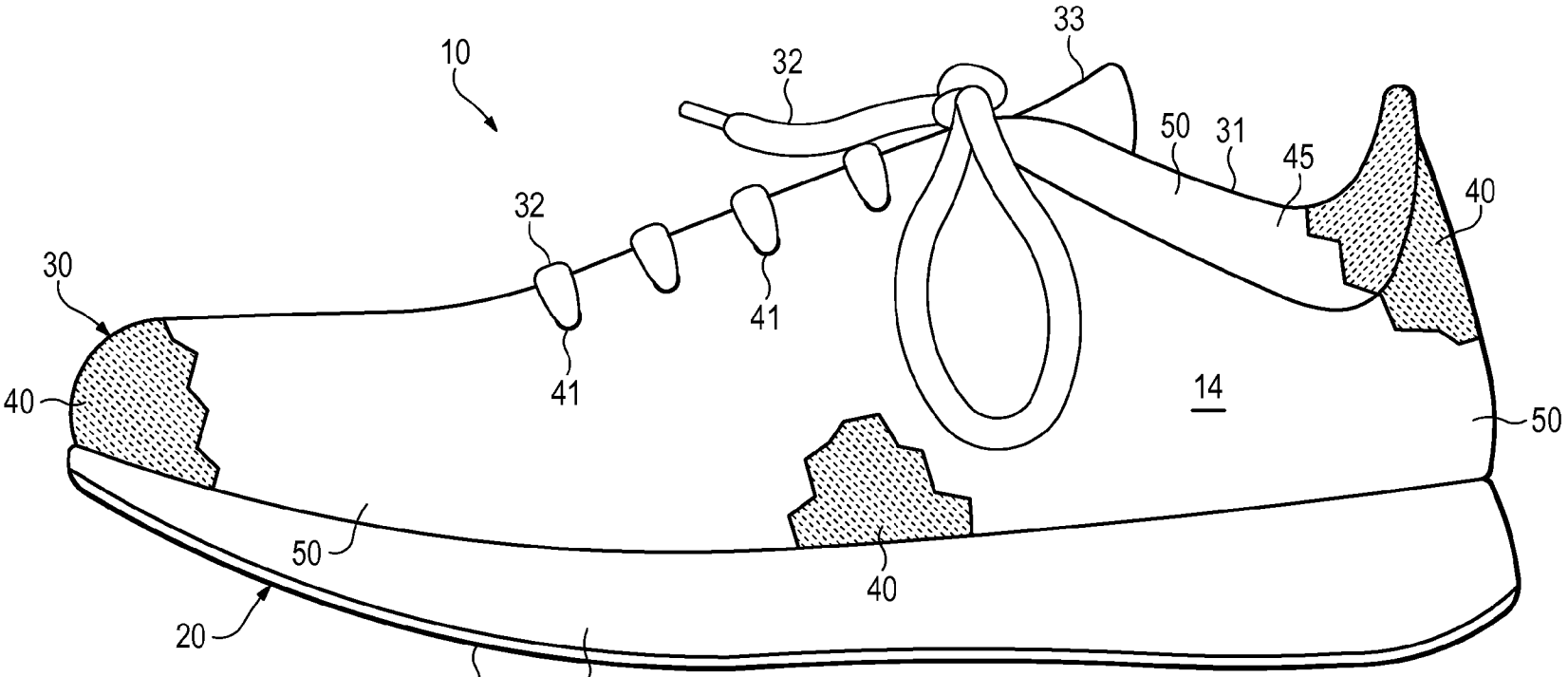
FIGS. 8A-8C are side elevational views corresponding with FIG. 2 and depicting further configurations of the article of footwear.
Figure 8B:
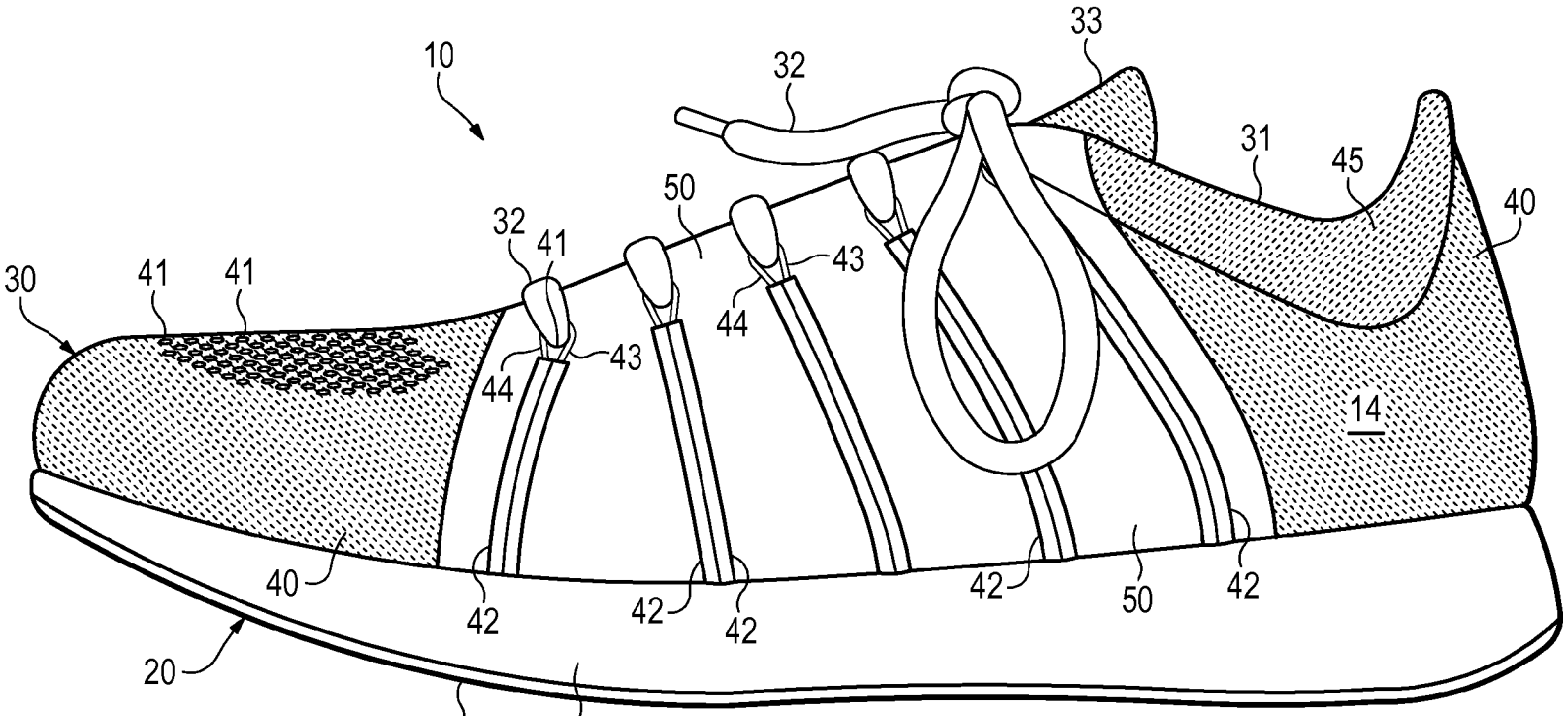
Figure 8C:
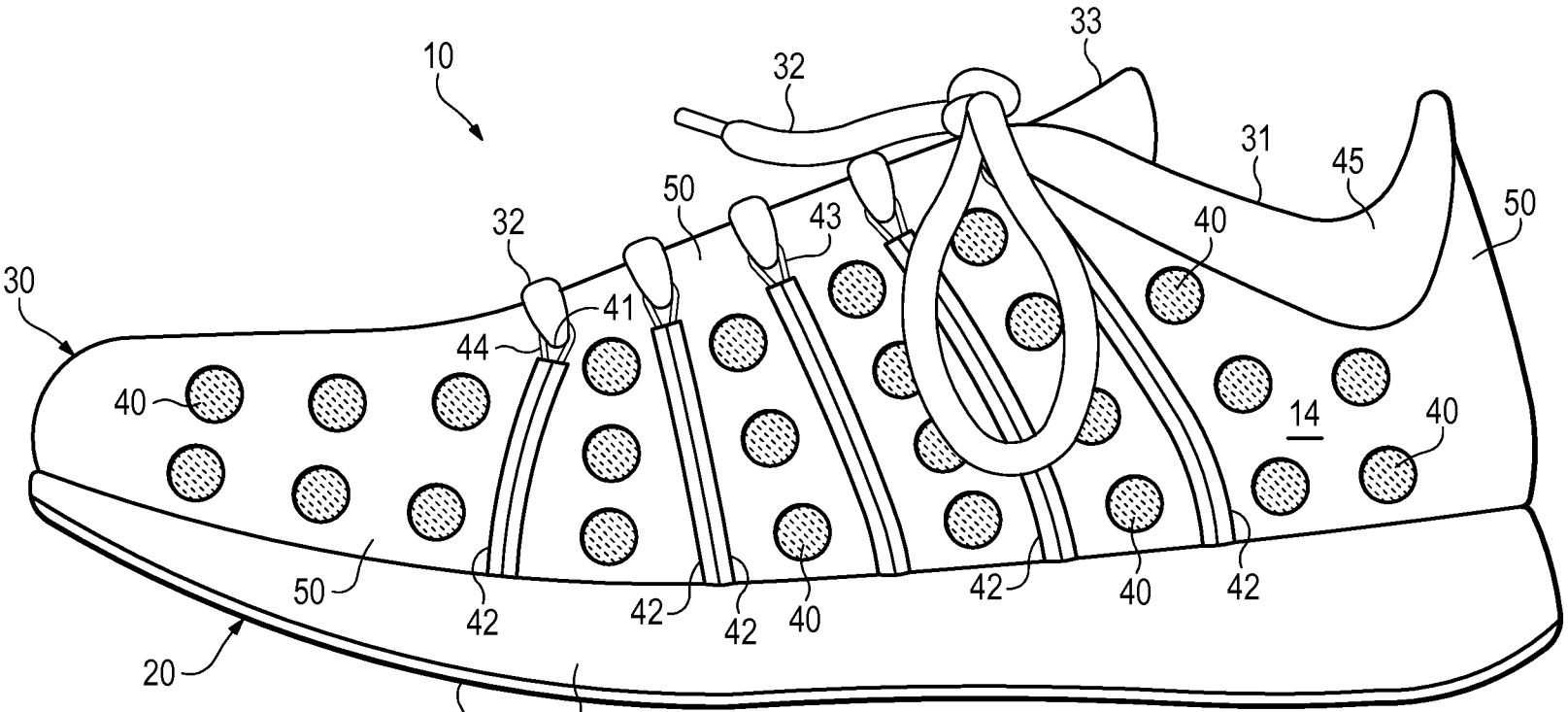

The features of upper 30 discussed above, including both knitted component 40 and polymer layer 50, provide one example of a suitable configuration for footwear 10. A variety of other configurations may also be utilized. As an example, FIG. 8A depicts a configuration wherein tubes 42 and strands 43 are absent from knitted component 40. Although polymer layer 50 may extend over substantially all of knitted component 40 and is depicted as forming a majority of the exterior surface of upper 30, polymer layer 50 may be absent in various areas to expose portions of knitted component 40. For example, FIG. 8B depicts a configuration wherein polymer layer 50 is primarily located in midfoot region 12 and exposes knitted component 40 in both of regions 11 and 13. In further configurations, polymer layer 50 may be absent in other areas. As an example, FIG. 8C depicts a configuration wherein polymer layer 50 defines various apertures throughout upper 30 that expose areas of knitted component 40. Various features of knitted component 40 may also vary. Further examples of variations for knitted component 40 may be found in U.S. Patent Application Publication 2010/0154256 to Dua, which is incorporated herein by reference. Additionally, U.S. patent application Ser. No. 13/048,514, which was filed in the U.S. Patent and Trademark Office on 15 Mar. 2011 and entitled Article Of Footwear Incorporating A Knitted Component, which is incorporated herein by reference, discloses additional configurations that may be utilized for knitted component 40.

Manufacturing Efficiency

The upper of conventional athletic footwear, for example, may be formed from multiple material elements that each impart different properties to various areas of the footwear. In order to manufacture a conventional upper, the material elements are cut to desired shapes and then joined together, usually with stitching or adhesive bonding. As the number and types of material elements incorporated into an upper increases, the time and expense associated with transporting, stocking, cutting, and joining the material elements may also increase. Waste material from cutting and stitching processes also accumulates to a greater degree as the number and types of material elements incorporated into the upper increases. Moreover, footwear with a greater number of materials, material elements, and other components may be more difficult to recycle than uppers formed from few elements and materials. By decreasing the number of elements and materials utilized in an upper, therefore, waste may be decreased while increasing the efficiency of manufacture and recyclability.

Whereas conventional uppers require a variety of manufacturing steps involving a plurality of material elements, upper 30 may be formed through the combination of (a) a flat knitting process for knitted component 40 and (b) a bonding process for securing polymer layer 50. Following the flat knitting and bonding processes, a relatively small number of steps are required to incorporate knitted component 40 and polymer layer 50 into footwear 10. More particularly, strobel sock 34 is joined to edges of knitted component 40, two edges in heel region 13 are joined, lace 32 is incorporated, and the substantially completed upper 30 is secured with sole structure 20. In comparison with conventional manufacturing processes, the use of knitted component 40 and polymer layer 50 may reduce the overall number of manufacturing steps. Additionally, waste may be decreased while increasing recyclability.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the upper comprising:

a knitted component formed of unitary knit construction, the knitted component including a tubular structure, the tubular structure comprising a first knitted layer and a second knitted layer that are overlapping and joined along opposite edges to form an unsecured central area of the tubular structure;

a strand having a configuration of a one-dimensional material, the strand extending through at least a portion of a length of the unsecured central area of the tubular structure;

a polymer layer bonded to the knitted component and forming a majority of an exterior surface of the upper; and wherein the polymer layer infiltrates and bonds to the first knitted layer of the tubular structure and remains unsecured to the second knitted layer of the tubular structure.

2. The article of footwear recited in claim 1, wherein the knitted component and the polymer layer extend along a lateral side of the upper, along a medial side of the upper, over a forefoot region of the upper, and around a heel region of the upper.

3. The article of footwear recited in claim 2, wherein the tubular structure is located on the lateral side of the upper and is oriented to extend upward from an area proximal the sole structure, and the strand extends outward from an end of the tubular structure to form a loop that receives a lace.

4. The article of footwear recited in claim 3, wherein the loop is located between the knitted component and the polymer layer.

5. The article of footwear recited in claim 3, wherein the knitted component defines an aperture positioned adjacent to the loop, and the lace extends through the aperture.

6. The article of footwear recited in claim 1, wherein the polymer layer is formed from a thermoplastic polymer material.

7. The article of footwear recited in claim 1, wherein the polymer layer is a non-woven textile formed from a thermoplastic polymer material.

8. The article of footwear recited in claim 1, wherein a first area of the knitted component has a first knit type and a second area of the knitted component has a second knit type, the first knit type being different than the second knit type.

9. The article of footwear recited in claim 1, wherein a first area of the knitted component has a first strand type and a second area of the knitted component has a second strand type, the first strand type being different than the second strand type.

10. An article of footwear having an upper and a sole structure secured to the upper, the upper comprising:

a knitted component formed of unitary knit construction and extending along a lateral side of the upper, along a medial side of the upper, over a forefoot region of the upper, and around a heel region of the upper;

a plurality of tubular structures disposed on the knitted component, the plurality of tubular structures including a first tubular structure and a second tubular structure disposed on at least one of the lateral side and the medial side of the upper, the first tubular structure and the second tubular structure being disposed adjacent to each other on the same side of the upper;

at least one strand located within the knitted component on one of the lateral side and the medial side, the strand extending upward through the first tubular structure from an area proximal the sole structure, the strand extending downward through the second tubular structure towards the area proximal the sole structure, and the strand extending outward from the knitted component between the first tubular structure and the second tubular structure to form one of a lateral loop on the lateral side and a medial loop on the medial side;

a lace extending through at least one of the lateral loop and the medial loop;

a polymer layer bonded to the knitted component and forming a majority of an exterior surface of the upper; and wherein at least one of the lateral loop and the medial loop are located between the polymer layer and the knitted component.

11. The article of footwear recited in claim 10, wherein the polymer layer comprises a plurality of apertures that expose portions of the knitted component on the exterior surface of the upper.

12. The article of footwear recited in claim 10, wherein the polymer layer comprises a polymer resin that has been applied onto a surface of the knitted component.

13. The article of footwear recited in claim 10, wherein a position of at least one of the lateral loop and the medial loop on the knitted component is secured by the polymer layer.

14. The article of footwear recited in claim 10, wherein the knitted component defines apertures positioned adjacent to the lateral loop and the medial loop, and the lace extends through the apertures.

15. The article of footwear recited in claim 10, wherein the knitted component forms a first knitted layer and a second knitted layer that are at least partially coextensive with each other and formed of unitary knit construction, the first tubular structure and the second tubular structure being formed by the first knitted layer and the second knitted layer overlapping and being joined along opposite edges to form an unsecured central area, and the strand extends through the unsecured central area between the first knitted layer and the second knitted layer of the first tubular structure and the second tubular structure.

16. The article of footwear recited in claim 10, wherein the polymer layer is formed from a thermoplastic polymer material.

17. The article of footwear recited in claim 10, wherein the polymer layer is a non-woven textile formed from a thermoplastic polymer material.

18. The article of footwear recited in claim 10, wherein a first area of the knitted component has a first knit type and a second area of the knitted component has a second knit type, the first knit type being different than the second knit type.

19. The article of footwear recited in claim 10, wherein a first area of the knitted component has a first strand type and a second area of the knitted component has a second strand type, the first strand type being different than the second strand type.

20. The article of footwear recited in claim 1, wherein the polymer layer has a substantially similar shape as the knitted component.

21. The article of footwear recited in claim 1, wherein the polymer layer has the configuration of a sheet of polymer material.

22. The article of footwear recited in claim 1, wherein the polymer layer comprises a polymer resin that is sprayed onto the knitted component.

* * * * *